United States Patent [19]

Hickey

[11] 3,998,313

[45] Dec. 21, 1976

[54] PAPER WEB AND INK RIBBON FEED CONTROL FOR CHARACTER PRINTER

[75] Inventor: Richard C. Hickey, Plano, Tex.

[73] Assignee: Docutel Corporation, Dallas, Tex.

[22] Filed: Nov. 22, 1974

[21] Appl. No.: 526,420

Related U.S. Application Data

[63] Continuation-in-part of Ser. No. 351,558, April 16, 1973, abandoned, which is a continuation-in-part of Ser. No. 297,218, Oct. 13, 1972, abandoned.

[52] U.S. Cl. ..... 197/133 P; 197/173; 197/187; 101/99

[51] Int. Cl.[2] ..... B41J 15/00

[58] Field of Search ..... 197/133 R, 133 F, 133 P, 197/151, 1 R, 173–174, 187; 101/93 R, 93.14, 93.48, 33 B, 99

[56] References Cited

UNITED STATES PATENTS

| | | | |
|---|---|---|---|
| 2,365,254 | 12/1944 | Dolan | 197/151 R |
| 2,983,356 | 5/1961 | Thompson | 197/133 R |
| 3,020,996 | 2/1962 | D'Onofrio | 197/133 R |
| 3,123,195 | 3/1964 | Hewitt | 197/133 R |
| 3,143,063 | 8/1964 | Stark | 101/93.02 |
| 3,157,330 | 11/1964 | Manor | 197/133 R X |
| 3,174,610 | 3/1965 | Barbagallo | 197/133 R |
| 3,200,739 | 8/1965 | Antonucci | 101/93 R |
| 3,232,229 | 2/1966 | Anderson | 197/151 X |
| 3,241,648 | 3/1966 | Stenudd | 197/1 R |
| 3,323,700 | 6/1967 | Epstein | 197/133 R |
| 3,334,722 | 8/1967 | Bernard | 197/133 R |
| 3,354,822 | 11/1967 | Dollot | 197/133 R X |
| 3,410,204 | 11/1968 | Burkhard | 197/133 R X |
| 3,420,166 | 1/1969 | Ellis | 197/133 R X |
| 3,420,352 | 1/1969 | Moran | 197/133 R |
| 3,432,020 | 3/1969 | Caudill | 197/151 R |
| 3,442,366 | 5/1969 | Spears | 197/151 |
| 3,481,446 | 12/1969 | Burkhardt | 197/151 |
| 3,511,354 | 5/1970 | Barcomb | 197/133 R |
| 3,658,163 | 4/1972 | Sniderman | 197/133 R |
| 3,673,955 | 7/1972 | Curtiss | 101/93.48 |
| 3,730,082 | 5/1973 | Perry | 101/93.14 |

FOREIGN PATENTS OR APPLICATIONS

| | | | |
|---|---|---|---|
| 358,914 | 5/1938 | Italy | 197/133 |

*Primary Examiner*—Edgar S. Burr
*Assistant Examiner*—A. Heinz
*Attorney, Agent, or Firm*—Richards, Harris and Medlock

[57] ABSTRACT

An automatic character printer includes a transport for indexing a receipt form by means of flexible belts having extending pins for engaging pin feed holes in the form. The receipt form includes a leading edge indexing mark and a trailing edge indexing mark to interrupt a light beam at an index sensor for establishing form position with respect to a character wheel at the print station. To distinguish between the form leading edge indexing mark and the form trailing edge indexing mark, a light interrupting signal wheel, synchronized with the rotation of the flexible belts, generates indexing signals related to the position of the belt extending pins. A receipt form is in a known location when the signal wheel and a form index sensor both generate a signal pulse. Upon receipt of a form start signal from a control computer, a hammer solenoid actuates a print hammer against a resilient pad to force the receipt form in contact with a character wheel. Recording ink for the character wheel is provided by a ribbon from a ribbon feed system including sensors for detecting ribbon movement and ribbon operation.

8 Claims, 19 Drawing Figures

PAPER WEB AND INK RIBBON FEED CONTROL FOR CHARACTER PRINTER

This is a continuation-in-part of application Ser. No. 351,558, filed Apr. 16, 1973, now abandoned, which is a continuation-in-part of application Ser. No. 297,218, filed Oct. 13, 1972, now abandoned.

This invention relates to a character printer, and more particularly to an automatically controlled character printer.

Heretofore, most character printers require the attendance of a human operator to insure proper operation thereof at all times. Further, previously available character printers usually employ a typewriter-like keyboard which is manually operated for character selection for printing such as on a receipt. While such character printers provide an acceptable system for character printing, such as the magnetic ink character for machine reading, where a human operator is involved, few completely automatic character printers are available.

For a completely automatic character printer, it is of prime importance to accurately know the position of the receipt form on which characters are to be printed. This is especially true where the receipt form contains identifiable data blocks in which certain data must be printed. For example, on a bank receipt, there are separate blocks for the bank number, account number, and a particular transaction amount. The position of each of these data blocks with respect to a character printer must be accurately known. Further, in addition to knowing the position of the receipt form, the machine must determine if the form is continuously moving past the character printer.

Another feature of an acceptable automatic character printer is the accurate determination of the printing of a character. After the correct character has been selected in accordance with an input signal, the printing of this character must be positively evaluated.

In character printers employing an inked ribbon, the continuous availability of such a ribbon to the character printer is essential. The ribbon moves through a feed system from a feed reel to a takeup reel sometimes at significantly high speeds of linear movement. Because of the fragile nature of most ribbons of this type, a minimum tension on the ribbon can be tolerated. For an unattended character printer, movement of the ink ribbon is continuously checked to insure a fresh supply at the print station.

In accordance with the present invention, a character printer includes drive means for moving a flexible belt having spaced pins extending therefrom for engaging and moving a receipt form past a print station. A form sensor positioned with respect to the flexible belts senses the beginning of the form transported by the drive means and generates a signal in response thereto. Synchronously moving with the drive means is a signal wheel that generates periodic pulses synchronized with the movement of engaging pins extending from the drive belt. A simultaneous occurrence of a signal from the signal wheel and the form sensor generates a signal to a computer, indicating that the form is in position to print at the first column location. A solenoid is then activated to drive a print hammer to force the receipt form against a character wheel. Movement of the print hammer is sensed and a signal generated to verify a character print.

Further in accordance with the present invention, a character printer as described in the preceding paragraph includes an inked ribbon feed system including means for sensing the ribbon movement past the character wheel. Tension means in the feed system responds to movement of the ribbon to maintain ribbon tension in a desired range of values.

A more complete understanding of the invention and its advantages will be apparent from the specification and claims and from the accompanying drawings illustrative of the invention.

Referring to the drawings:

FIG. 1 schematically illustrates the character printer in accordance with the present invention including flexible metal belts with extending pins for form transport;

Figure 1:
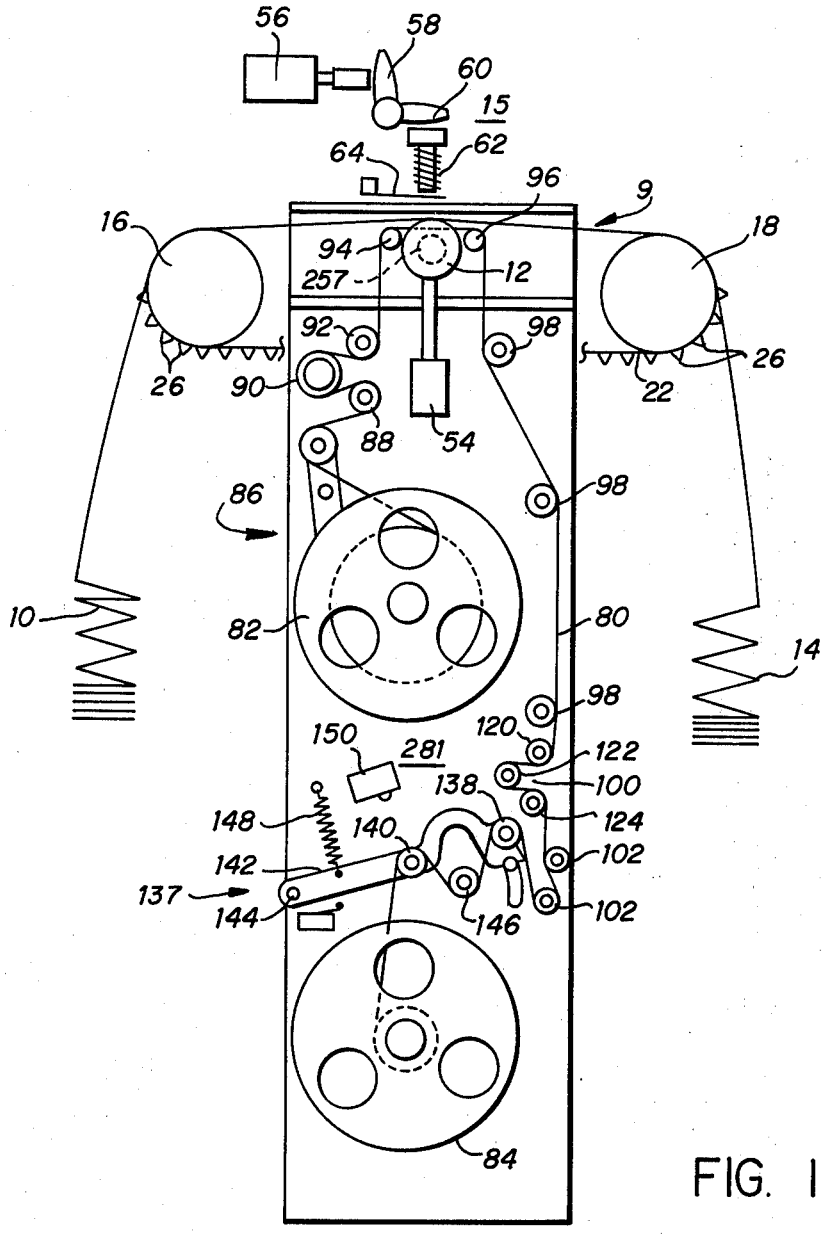
Figure 2:
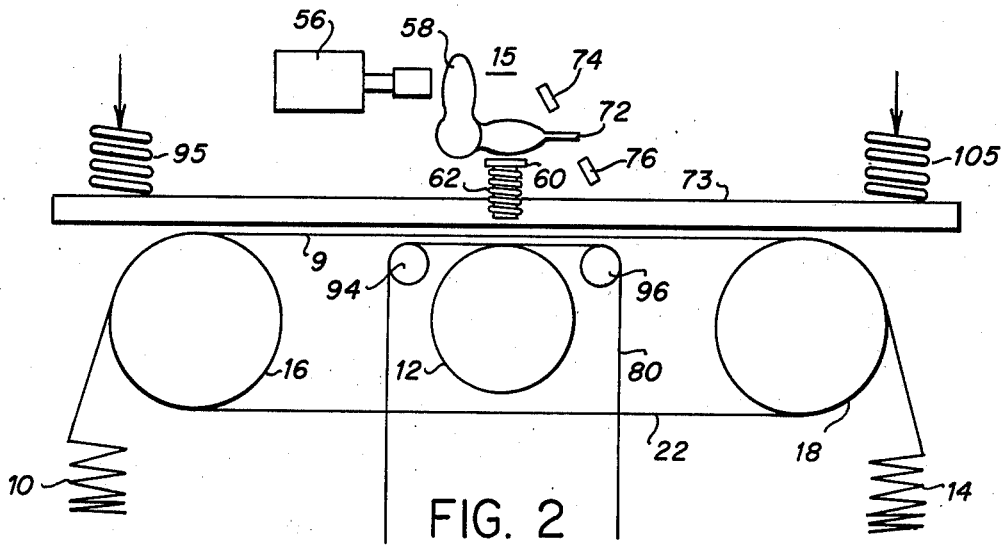
FIG. 2 is an expanded view of the character wheel and print hammer for printing characters on a receipt form.
Figure 3:
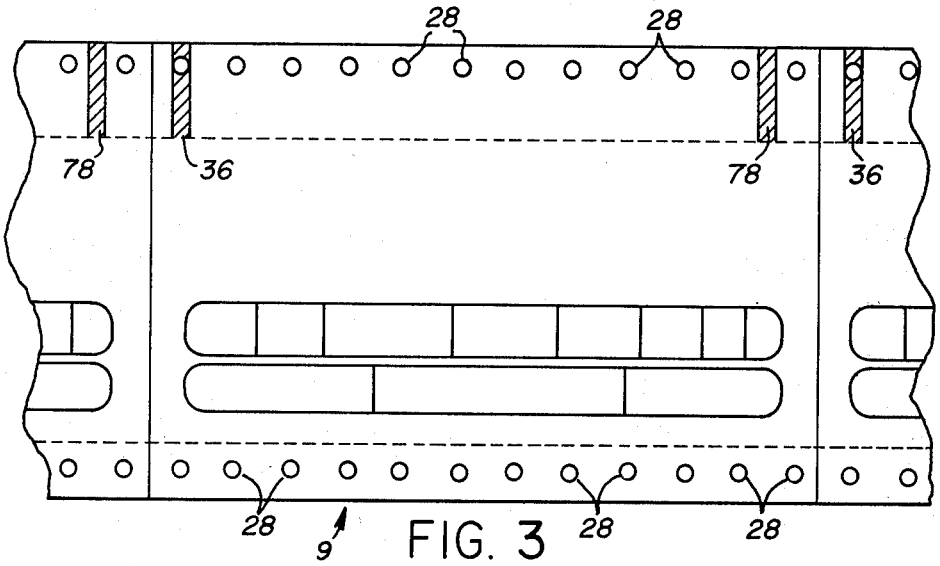
FIG. 3 illustrates a typical receipt form for use with the character printer of the present invention having a leading index mark and a trailing index mark.

Referring to FIGS. 1 and 2, a continuous train of receipt forms 9, such as shown in FIG. 3, is transported from a stack 10 past a character wheel 12 and discharged into a stack 14 after having a desired character printed thereon. To positively and accurately transport the receipt forms 9 from the stack 10 past the character wheels 12, drive wheels 16 and 18 are positioned upstream and downstream of the character wheels 12 and driven by a stepper motor 19 in response to control voltages.

Figure 4:
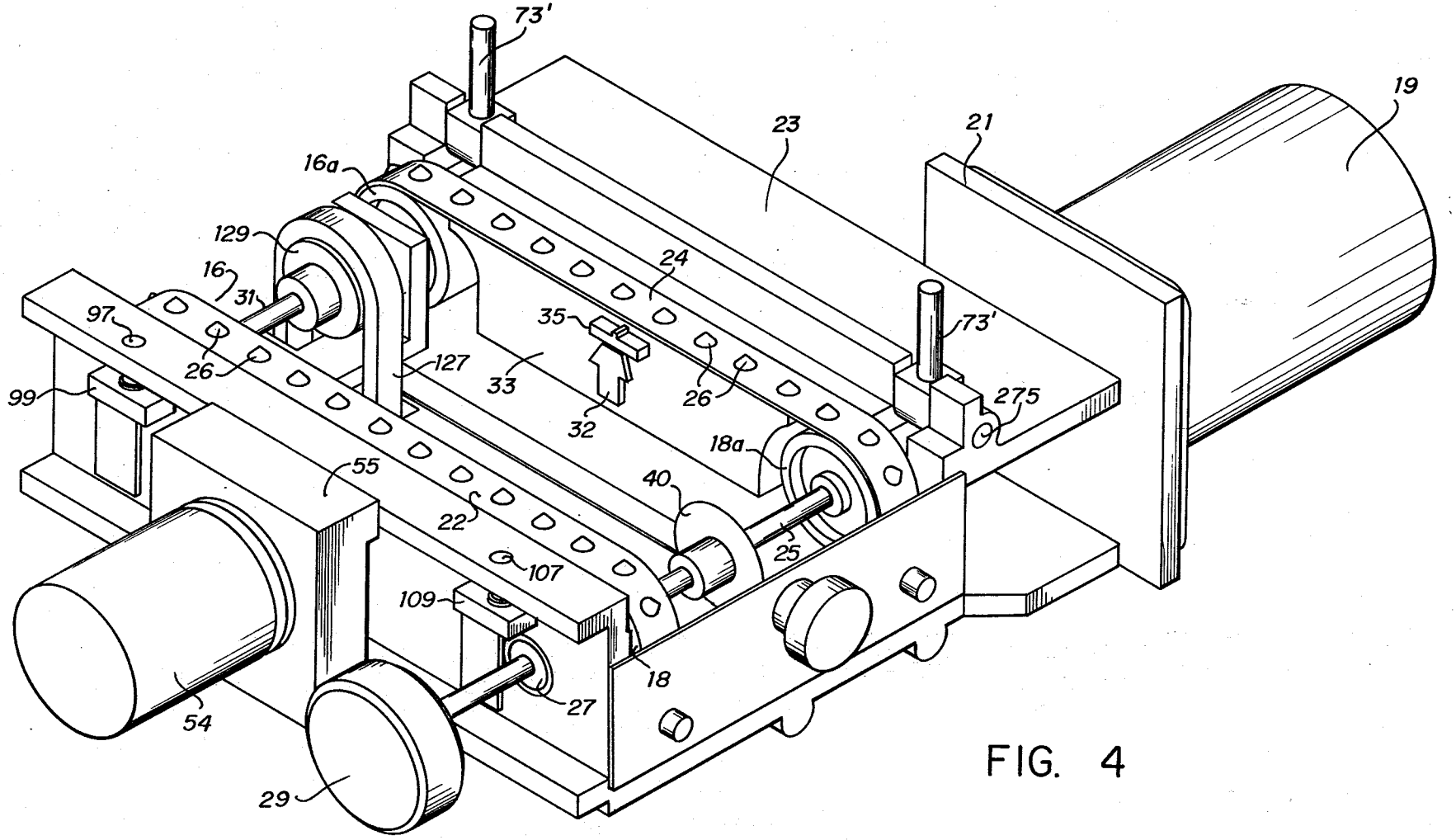
FIG. 4 is an isometric view of the receipt form feed assembly including the flexible metal belt drive and character wheel drive.

Referring to FIG. 4, there is shown a pictorial assembly of the receipt form feed transport including the stepper motor 19 supported by a motor flange 21 on a form feed frame 23. Coupled to the output shaft (not shown) of the stepper motor 19 is a drive shaft 25 with drive wheels 18 and 18*a* attached thereto. The drive shaft 25 is rotatably mounted in the frame 23 by means of a bearing 27 and has a form advance knob 29 attached thereto for manually rotating the drive wheels 18 and 18*a*.

Figure 6:
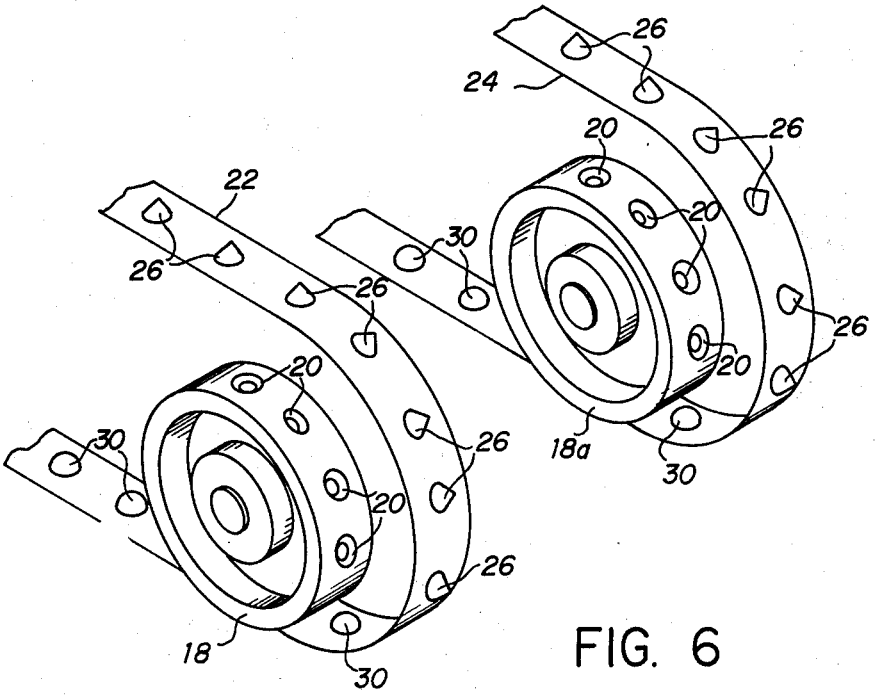
FIG. 6 is an isometric view of drive wheels of the drive mechanism for moving the flexible metal drive belts.

There are two sets of drive wheels 16 and 18, as also shown in FIG. 6, one on each end of the receipt form 9. The drive wheels 16 and 16*a* are supported on a form feed shaft 31 rotatably mounted in the frame 23. As best illustrated in FIG. 6, each of the drive wheels 16, 16*a*, 18 and 18*a* have formed around the circumference thereof a series of indentations 20 for engaging positioning buttons 30 on the inner surface of flexible metal belts 22 and 24 extending between the drive wheels 16, 16*a*, 18, 18*a*. As shown in FIG. 4, the flexible metal belt 24 is supported on a guide bar 33 attached to the frame 23; the metal belt 22 is similarly supported by a guide bar (not shown).

Two of the flexible metal belts 22 and 24 are thus utilized to feed receipt forms 9 from the stack 10 past the character wheels 12. Each of these flexible metal belts 22 and 24 forms a continuous loop with form-engaging metal positioning pins 26 extending outwardly to engage pin holes 28 in a receipt form 9.

The indentations 20 in the drive wheels 16 and 18 engage positioning buttons 30 on the inner side of the flexible belt 22 and are individually radially in line with the extending positioning pins 26. Thus, by means of the indentations 20 in the drive wheels 16, 16*a*, 18, 18*a* engaging the positioning buttons 30 and the extending positioning pins 26 engaging the pin feed holes 28 in the form 9, positive and accurate movement of receipt forms 9 from the stack 10 past the character wheels 12 is maintained.

Figure 7:
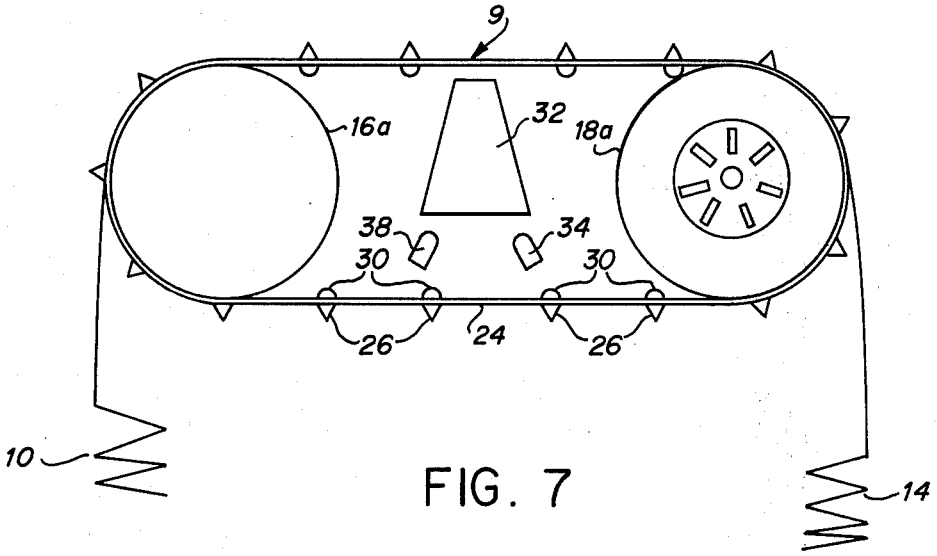
FIG. 7 is an expanded view of the flexible metal drive belts with extending form engaging pins and a form position sensor.

Prior to beginning a print sequence on a receipt form 9, the position of the receipt form 9 with respect to the character wheels 12 at a print station 15 must be determined. Referring to FIG. 7, as the leading edge of the receipt form 9 passes a position sensor 32 light from the source 34 is absorbed by a form leading index mark 36 and a light sensor 38 generates a leading index signal. As shown in FIG. 4, the position sensor 32 is fastened to the guide bar 33 to clear the inner edge of the flexible metal belt 24. Mounted above the sensor 32 is a lens 35 for concentrating light reflected from a passing form 9.

Figure 8:
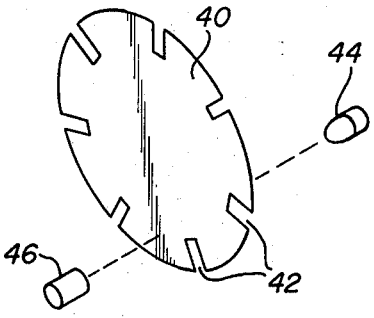
FIG. 8 is an isometric view of a signal wheel and associated sensors for responding to the movement of the flexible metal belts.
Figure 9:
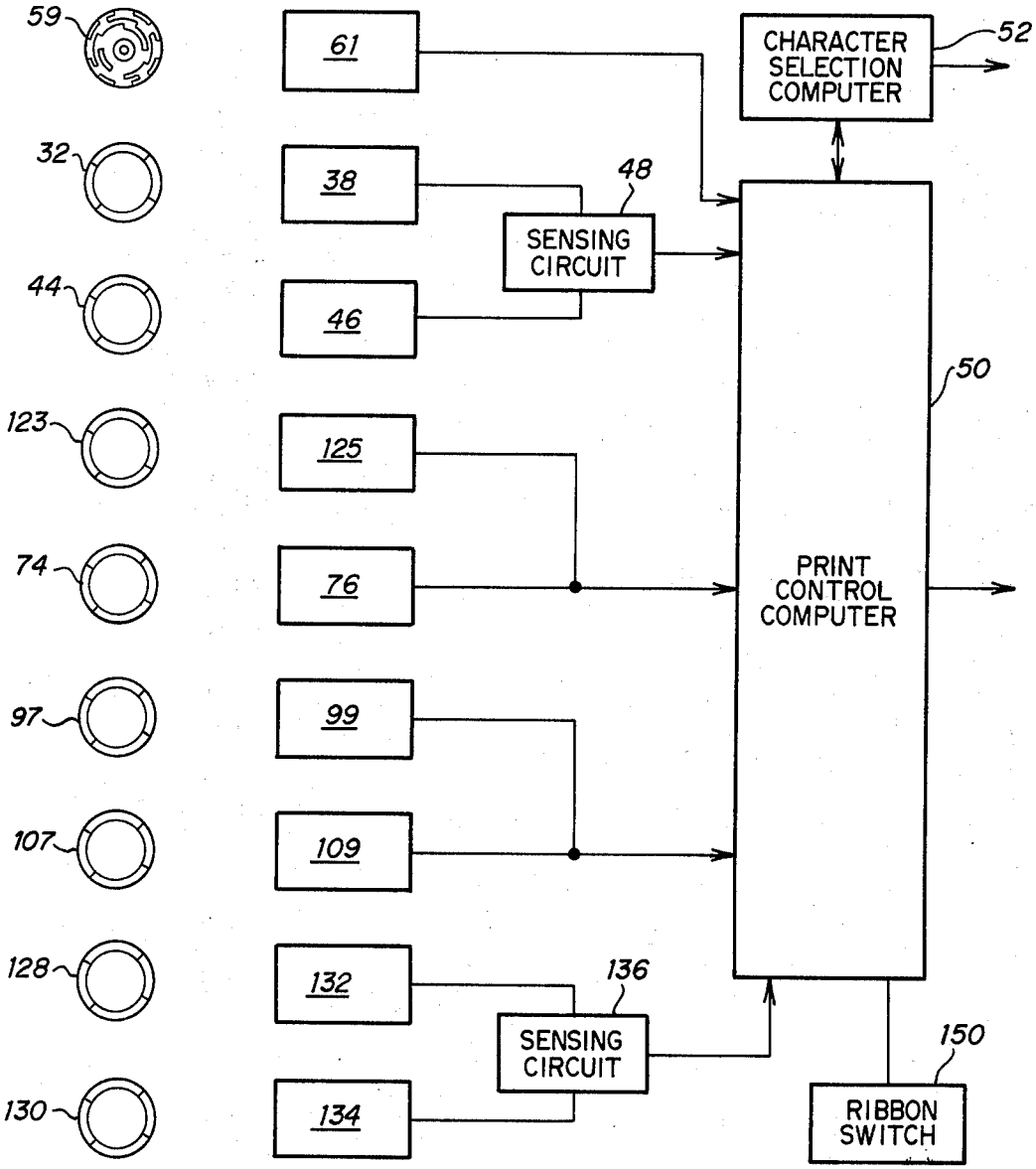
FIG. 9 is a block diagram of a control system for operation of the hammer drive solenoid and character wheel of FIG. 1.

At the same time, a signal wheel 40, having spaced slots 42, referring to FIG. 8, is rotating in synchronism with the drive wheels 16 and 18. The signal wheel 40 is mounted on the drive shaft 25 and rotates therewith. Simultaneously with the generating of the leading index signal from the sensor 38, the signal wheel 40 passes light from a source 44 (see also FIG. 5) to a sensor 46 to generate a belt position signal. When both the signals from the sensor 38 and 46 occur simultaneously, a control signal is generated from an AND gate sensing circuit 48, referring to FIG. 9, to a print control computer 50. This signal from the AND gate sensing circuit 48 notifies the print control computer 50 that a receipt form 9 is positioned above the character wheels 12 and is ready to begin a printing sequence.

Figure 5:
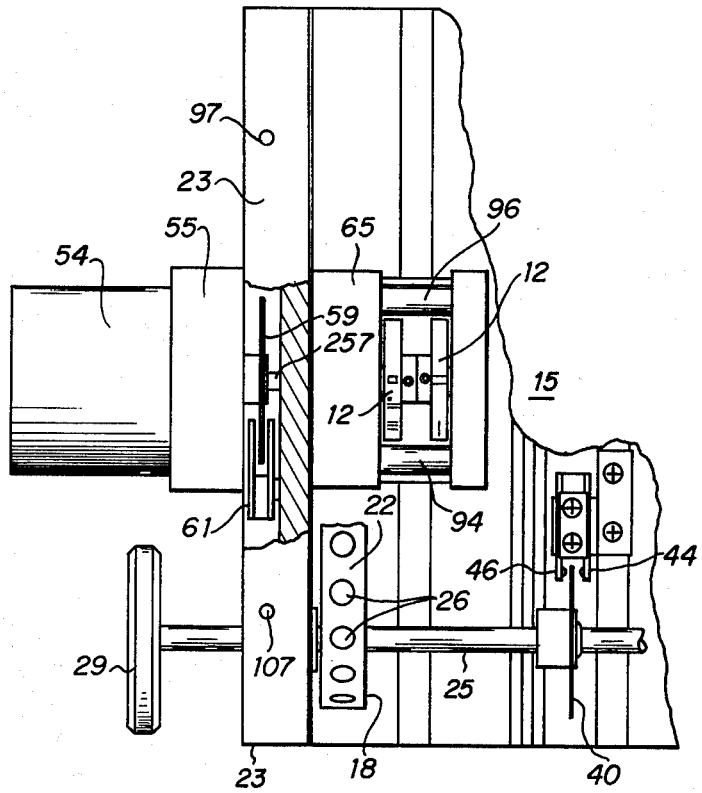
FIG. 5 is a top view of the assembly of FIG. 4 broken away to show in greater detail the character wheel and sensor encoder therefor.
Figure 10:
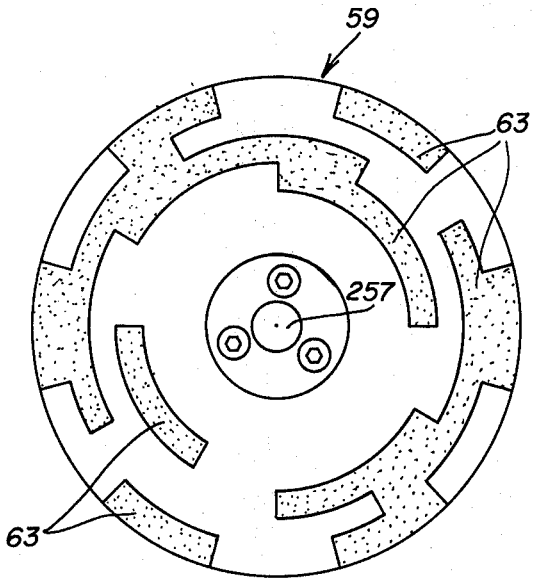
FIG. 10 is a side view of the encoder wheel for the sensor encoder of the character wheel assembly.

Prior to the form 9 being positioned over the character wheels 12, a character selection computer 52 generates a signal to a character wheel stepper motor 54 for rotating the character wheels 12 such that a desired character may be imprinted on the receipt form 9. Typically, the print control computer 50 and the character selection computer 52 are combined into a single unit mini-computer such as available from the Lockheed Corporation and identified by the model designation Lockheed MAC-16. A complete and detailed analysis and explanation of interfacing with the Lockheed MAC-16 will be found in the Lockheed Electronics MAC-16 Interface Manual No. TM130100009600. Alternatively, the print control computer 50 and the character selection computer 52 are a single unit mini-computer having a model designation CAI-NAKED MINI, as available from Computer Automation, Inc. Referring to FIGS. 4 and 5, the stepper motor 54 is mounted on a character wheel flange 55 supported on the form feed frame 23 on the side opposite from the stepper motor 19. The stepper motor 54 has a shaft 257 extending therefrom to support the character wheels 12 below a traveling receipt form 9. Also attached to the shaft 257 is an encoder wheel 59, as shown in FIG. 10, rotating between a sensor encoder 61. The sensor encoder 61 comprises an array of light sources and light responsive sensors (not shown) that generate character location signals to the print control computer 50. To identify which character is in position to be printed, the encoder wheel 59 includes a pattern of character identifying code segments 63 at various radial distances from the shaft 257. As any distinct pattern of these character identifying code segments 63 passes through the sensor encode 61 a particular character signal is generated to the computer 50.

Figure 11:
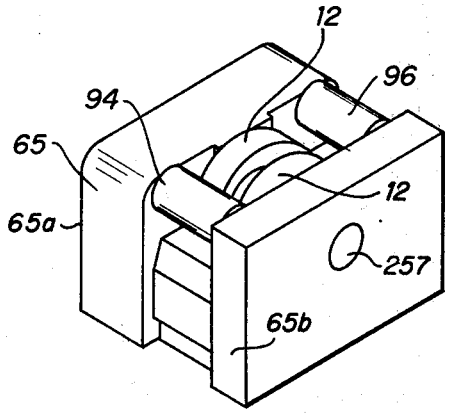
FIG. 11 is an isometric view of the character wheel assembly as also shown in FIG. 5.

Referring to FIG. 11, there is shown in detail the character printer including character wheels 12 supported on the shaft 257 in a housing 65. The housing 65 comprises two end plates 65*a* and 65*b* with the character wheels 12 rotating between the plates 65*a* and 65*b*. Upstream and downstream of the character wheels 12 there is rotatably mounted ribbon idlers 94 and 96, the function of which will be explained.

Figure 12:
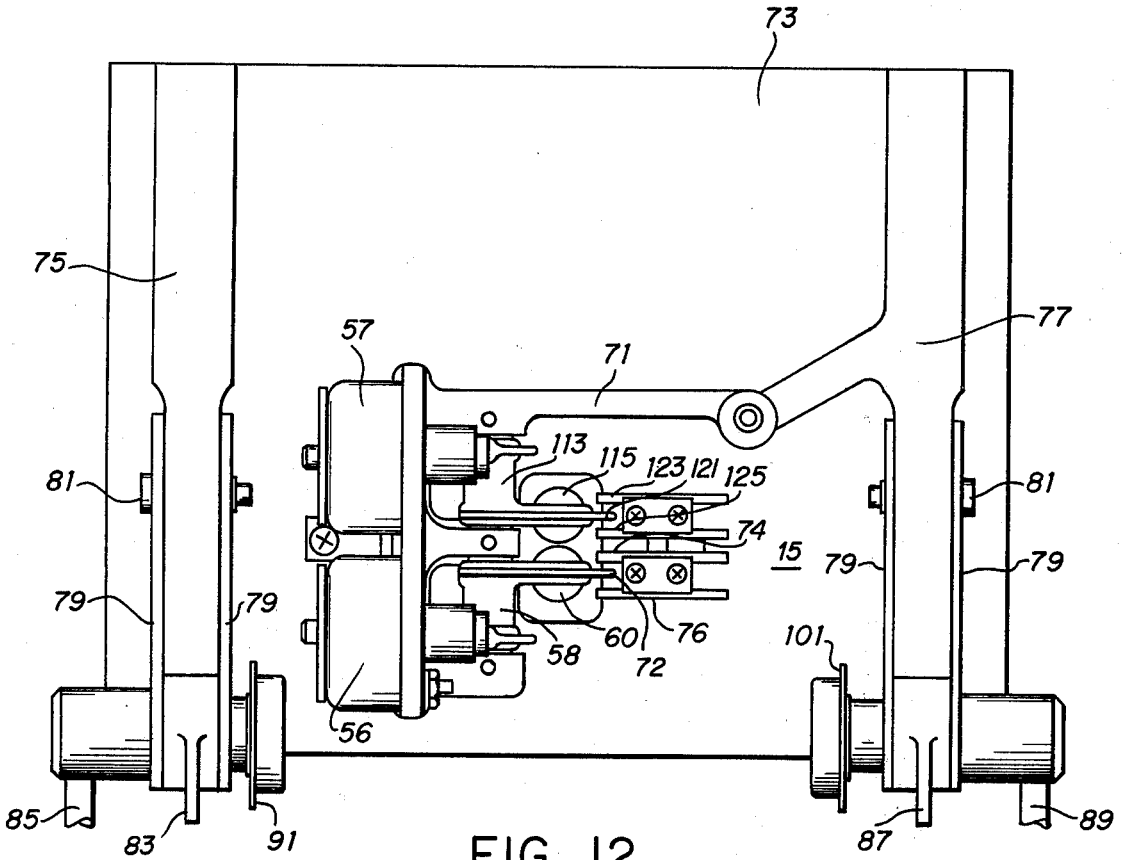
FIG. 12 is a top view of the hammer platform including hammer solenoids actuated during a printing sequence.
Figure 13:
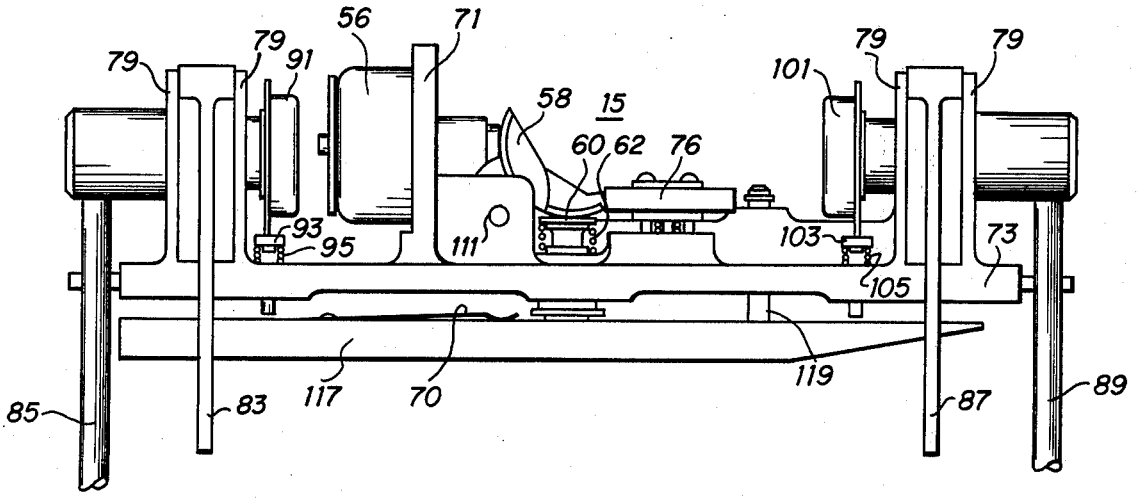
FIG. 13 is an end view of the hammer platform of FIG. 12.

Referring to FIGS. 1, 12 and 13, the printing sequence now commences by generating an instruction from the print control computer 50 to hammer solenoids 56 and 57. Both the solenoids 56 and 57 are attached on a solenoid support 71 mounted to the top side of a hammer platform 73 supported on pins 73'. The hammer platform 73 is pivotally mounted by means of a shaft 275 on the form feed frame 23. When in an operating position, the hammer platform 73 is rotated to extend across the frame 23.

Also attached on the hammer platform 73 are clamp supports 75 and 77 each having pivot arms 79 pivotally attached thereto by means of pivot pins 81. Considering the left side of the hammer platform 73, the arms 79 support a latch clamp 83 that rotates with and by means of a latch handle 85. Similarly, with reference to the right side of the platform 73, the arms 79 support a latch clamp 87 rotatable with and by means of a latch handle 89.

A cam 91, rotatable by means of a latch handle 85, engages a plunger 93 extending through the platform 73. The plunge 93 is spring loaded into an upper position by means of a spring 95. When the hammer platform 73 is rotated to an operating position, the plunger 93 contacts a switch pin 97, referring to FIG. 4, that actuates a position switch 99. Similarly, mounted to rotate with the latch handle 89 is a cam 101 engaging a plunger 103 extending through the platform 73. The plunger 103 is spring loaded into an upper position by means of a spring 105. With the platform 73 rotated into an operating position, the plunger 103 makes contact with a switch pin 107 that actuates a position switch 109. Actuating the switches 99 and 109 signals the print control computer 50 that the hammer platform 73 is in an operating position.

Energizing the hammer solenoid 56 rotates a rocker arm 58 to drive a hammer 60 downward against the bias of a spring 62. The rocker arm 58 is supported by means of a rocker arm shaft 111 in a frame as part of the support 71. Also rotatably mounted on the shaft 111 is a rocker arm 113 rotated by energizing the hammer solenoid 57. Energizing the hammer solenoid 57 rotates the rocker arm 113 to drive a hammer 115 against the bias of a spring (not shown).

To insure a positive contact of a receipt form 9 with the character wheels 12 during a printing sequence, a pressure plate 117 is mounted below the platform 73 by means of guide pins 119. The pressure plate 117 floats on the guide pins 119 with respect to the platform 73 to force a receipt form 9 downward into a printing position.

Figure 14:
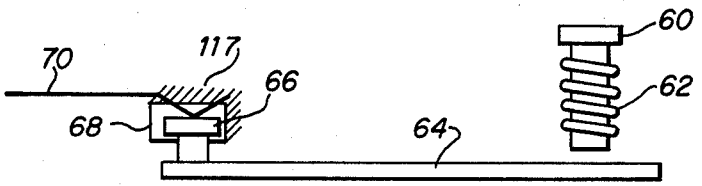
FIG. 14 is a detail of a resilient hammer arm interposed between the print hammer and the receipt form.

The downward movement of the hammer 60 flexes a resilient arm 64, as best illustrated in FIG. 14, to force the receipt form 9 in contact with the character wheels 12 for printing of a character on the form 9. The flexible arm 64 provides a resilient interface between the hammer 60 and the receipt form 9. A similar arrangement is provided for the hammer 115. This improves the quality of the print character to improve subsequent reading thereof by automatic character reading machines. The resilient arm 64 is a disposable item and includes a positioning knob 66 for inserting into a slot 68 as part of the pressure plate 117 for the character printer. A spring 70 maintains the resilient arm 64 in place with respect to the hammer 60.

After movement of the hammers 60 and 115 to cause printing of a character on the receipt form 9, the system is sequenced for additional character printing. A check is made to insure that the character has been printed. This check is implemented by means of a flag 72 extending from the rocker arm 58 to interrupt a light beam from a source 74 to a sensor 76. Similarly, a flag 121 extends from the rocker arm 113 to interrupt a light beam from a source 123 to a sensor 125. Thus, each time the solenoids 56 and 57 rotate the rocker arms 58 and 113, respectively, the light beam between the sources 74 and 123 and the sensors 76 and 125 is interrupted. This generates a character print signal to the print control computer 50. The character selection computer 52 again actuates the stepper motor 54 to index the character wheels 12 to the next character for printing on the receipt form 9. The solenoids 56 and 57 are again actuated and a second character is printed.

The individual character printing continues through the various data blocks on the receipt form 9. The form is accurately moved past the character wheels 12 by operation of the drive wheels 16 and 18 and movement of the flexible metal belts 22 and 24. When the last data block on the receipt form 9 is positioned above the character wheels 12, a trailing index mark 78 interrupts the light beam from the source 34 as reflected from the form 9 to the sensor 38. At this time, however, because the mark 78 is located between pin feed holes 28 in the receipt form 9, the signal wheel 40 is positioned such that light from the source 44 is interrupted to the sensor 46. In this situation, only the sensor 38 generates a signal to the AND gate sensing circuit 48 which now sends an instruction to the print control computer 50 indicating the end of the receipt form 9. This disenables the computer 50 from energizing the hammer solenoids 56 and 57 and the print operation shuts down. It will remain in a shut down condition until the next leading index mark 36 generates a start signal from the sensor 38 and at the same time the sensor 46 generates a signal in response to the position of the signal wheel 40. At this time, the AND gate sensing circuit 48 again receives signals from both the sensors 38 and 46 and sends instructions to the print control computer 50 to actuate the hammer solenoids 56 and 57 after positioning the character wheels 12.

After the print control computer 50 receives instructions from the AND gate sensing circuit 48 to actuate the hammer solenoids 56 and 57, additional pulses are received from the sensor 46 as a result of operation of the signal wheel 40. Each time a slot 42 allows passage of light from the source 44 to the sensor 46, a pulse signal is transmitted through the AND gate sensing circuit 48 to the print control computer 50. The print control computer 50 stores and counts each of the pulse signals. The stored pulses are compared with a set maximum as determined by the number of pin feed holes 28 between the marks 36 and 78. These slots 42 are so positioned in the signal wheel 40 such that after 10 additional pulses from the sensor 46, after the index mark 36, the print control computer 50 must receive a signal from the sensor 38, indicating the presence of the index mark 78, or the entire system shuts down.

Assume that the receipt form 9 has been torn or jammed in the system. In this case, the drive wheels 16 and 18 continue to move the endless, flexible belts 22 and 24 and also rotate the signal wheel 40. With the print control computer 50 set to recognize ten pin feed holes 28 in each form 9 between index marks 36 and 78, when this number is exceeded, it is an indication of a system malfunctioning requiring a shutdown.

The character printer of FIG. 1 utilizes an inked ribbon 80 in a ribbon feed 281 for passing over the character wheel 12 for imprinting on the receipt form 9. This ribbon 80 is stored on a feed reel 82 and taken up on a takeup reel 84. Typically, one or both of the reels 82 and 84 may be driven by a conventional motor (not shown) in response to signals from the print control computer 50. Each time a character is printed, the ribbon 80 indexes one character position to provide a fresh and continuous supply of ink for the character wheels 12. The ribbon 80 from the feed reel 82 passes over a tension idler 86, over a lower capstan idler 88, past a capstan 90, under an upper capstan idler 92 and then past the character wheels 12 by means of ribbon idlers 94 and 96. The capstan 90 is driven by a belt 127 by means of a pulley 129 fastened to the form feed shaft 31. Used ribbon 80 from the print station 15 passes over guide rollers 98 to a ribbon movement detector 100 past additional idlers 102 and through a broken ribbon detector 137 to the takeup reel 84.

Figure 15:
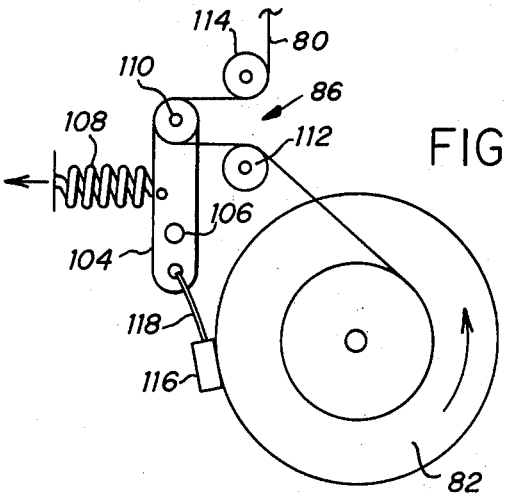
FIG. 15 is an expanded view of a part of the inked ribbon feed systemm of FIG. 1 illustrating a tensioning maintaining mechanism.

In the successful operation of a completely automatic character printer, the movement of the inked ribbon 80 past the character wheels 12 is important. Referring to FIG. 15, there is shown a detail of the tension idler 86 for maintaining a desired minimum tension on the ribbon 80 to prevent breakage thereof in response to a call for a rapid movement past the character wheels 12. An idler arm 104 is pivoted at a point 106 and biased by a spring 108 to rotate in a counterclockwise direction. Rotatably mounted on the idler arm 104 is an idler 110 in an arrangement with idlers 112 and 114 such that ribbon 80 from the feed reel 82 passes first over the idler 112, around the idler 110, and then from the idler 114 to the lower capstan 88. Attached to the lower portion of the arm 104 is a tension pad 116 at the end of a leaf spring 118.

When the ribbon 80 is to be moved past the character wheels 12, the inertia of the feed wheel 82 resists movement thereof such that an increased tension is exerted on the ribbon 80. To control this tension, the idler arm 104 rotates about the pivot 106 against the spring 108 and the tension is relieved. Rotation of the arm 104 also causes the pad 116 to be moved away from the feed reel 82 allowing freer movement thereof. Because of the mass of the reel 82, it has a tendency to continue to rotate after the ribbon 80 has been positioned at the character wheels 12. When tension is again relieved on the ribbon 80, the spring 108 rotates the idler arm 104 counterclockwise and again forces the pad 116 against the reel 82 thereby braking its motion. Thus, a smooth flow of ribbon 80 past the character wheels 12 is maintained.

Figure 16:
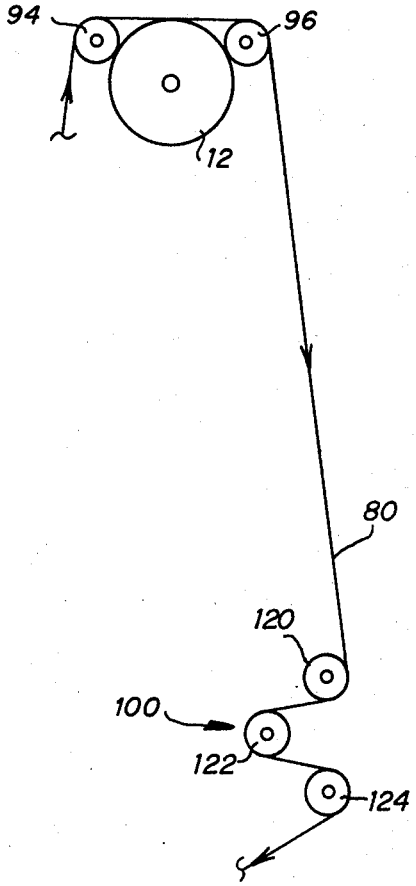
FIG. 16 is also an expanded view of the inked ribbon feed system of FIG. 1 showing the ribbon movement sensor idler wheel.

After each printing of a character on the print form 9, a fresh supply of ribbon 80 is supplied to the character wheels 12. A check on the movement of the ribbon 80 is made by the movement detector 100. As shown in FIG. 16, the movement detector 100 incudes an idler 120 for feeding the ribbon 80 past a sensing roller 122. As the ribbon 80 leaves the roller 122 it passes over an idler 124 to the broken ribbon detector 137.

Figure 17:
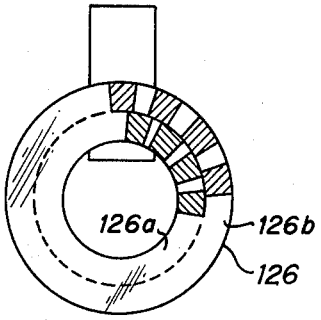
FIG. 17 is a plan view of the sensor disc of FIG. 16 for determining ribbon movement.

Rotating with the sensing roller 122 is a coded disc 126, as shown in FIG. 17. The coded disc 126 includes two concentric rings, an inner ring **126*a* of light and dark areas surrounded by an outer ring 126*b* of alternately light and dark areas. The dark portions are sized such that the leading and trailing edges of the outer ring 126*b* overlap the trailing and leading edges, respectively, of dark portions of the inner ring 126*a*. These light and dark segments of the disc 126 are positioned to interrupt light from sources 128 and 130 to sensors 132, 134**.

Figure 18:
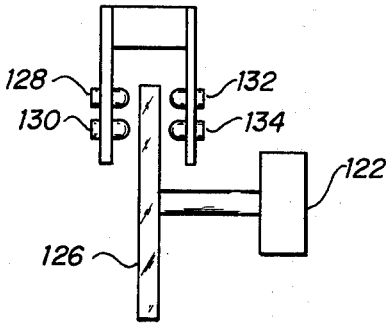
FIG. 18 is an end view of the disc of FIG. 17 showing the position of movement sensors with relation to the disc.

Referring to FIG. 18, there is shown an end view of the coded disc 126 positioned between light sources 128 and 130 and sensors 132, 134. By the arrangement of the light and dark areas on the inner and outer rings **126*a*, 126*b* of the disc 126, the sensors 132 and 134 alternately generate light and dark signals to a latching NAND gate sensing circuit 136. The latching NAND gate sensing circuit 136 responds to signals from the sensors 132 and 134 to generate a ribbon movement instruction to the print control computer 50**.

By overlapping the leading and trailing edges of the dark portions of the inner and outer rings **126*a*, 126*b* of the disc 126, a positive sensing of the movement of the ribbon 80 is assured. By using two concentric sensing rings 126*a*, 126*b* with overlapping dark portions, erroneous movement signals are minimized. For example, with only one sensing ring of light and dark areas, a dithering movement of the ribbon 80 may generate alternately light and dark signals to the latching NAND gate sensing circuit 136 thereby sending an instruction to the computer 50 that the ribbon 80 is moving, when in fact there is only a slight dithering motion. The provision of the second sensing ring insures that ribbon movement must be taking place before the proper sequence of signals will be generated by the sensors 132 and 134 to generate a ribbon movement signal to the print control computer 50**.

At any time the latching NAND gate sensng circuit 136 fails to receive the proper sequence of signals from the sensors 132 and 134, an instruction is given to the print control computer 50 to shut down the system as a malfunction in the ribbon feed has occurred.

One additional check on the ribbon feed mechanism 281 is completed by the broken ribbon detector 137 comprising a loop arm idler 138 and a loop idler 140 attached to an idler arm 142 pivoted about a pin 144. A loop tension idler 146 is in the ribbon loop between the idlers 138 and 140. A spring 148 biases the arm 142 in a counterclockwise direction against a tension produced by the ribbon 80 passing over the idlers 138 and 140.

If a break in the ribbon 80 occurs, the arm 142 rotates counterclockwise by means of the spring 148 against a broken ribbon switch 150. Actuating the switch 150 sends an instruction to the print control computer 50 indicating a broken ribbon condition and the system shuts down.

Figure 19:
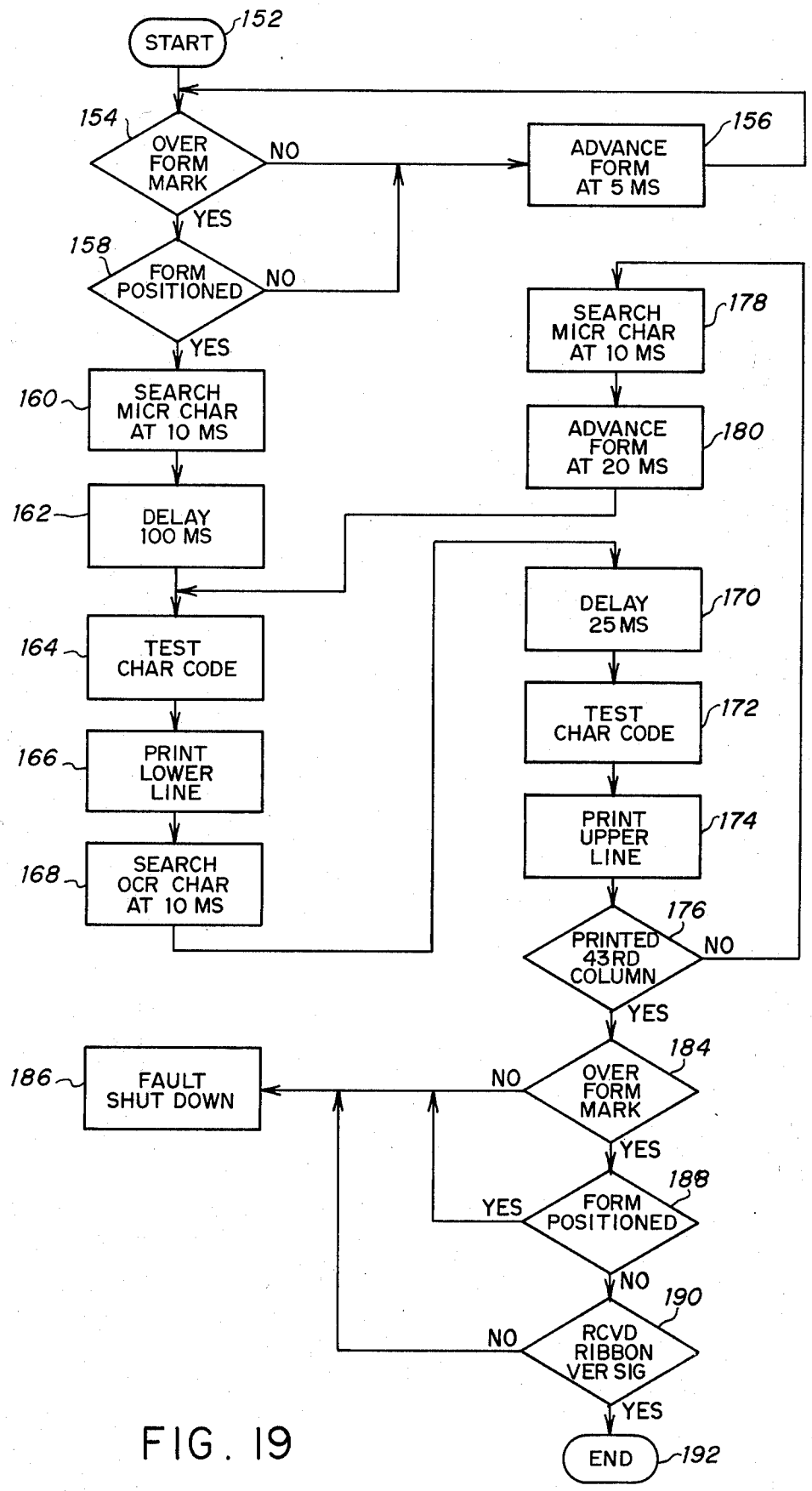
FIG. 19 is a flow diagram showing the sequence of operation of the character printer of the present invention.

Referring to FIG. 19, there is shown a flow chart of the operation of the heretofore described character printer as controlled by the print control computer 50. Initially, the computer 50 receives an instruction 152 to begin the print sequence. An inquiry 154 is continuously repeated to determine if the index mark 36 has interrupted a light path from the source 34 to the sensor 38. A negative response to the inquiry 154 advances the sequence to step 156 to energize the stepper motor 19 for the drive wheels 16 and 18 to advance the receipt form 9 at a fixed speed. Upon receiving a positive response from the inquiry 154 the computer 50 advances to inquiry 158 to determine if the signal wheel 40 is in a position such that the sensor 46 generates a signal to the sensing circuit 48. A negative response to the inquiry 158 returns the operation of the system to step 156 for continued advancement of the receipt form 9.

A positive response to the inquiry 158 advances the system sequence to step 160 wherein the character selection computer 52 rotates the character wheels 12 to a desired character. A delay step 162 follows the character selection during which time the actual setting of the character wheels 12 takes place. The character code is then tested in a step 164 and upon completion of the step 164 the computer 50 sends an instruction to energize the hammer solenoid 56 to print a character in a selected data block. This is shown by step 166 of FIG. 19.

Upon completion of printing of the character in step 166, the character selection computer 52 is again actuated to select another character for printing on the receipt form 9. This step is evidenced by the block 168 following which a delay of 25 milliseconds is generated at step 170 to enable positioning of the character wheels 12. The character is tested at step 172 and following this test the print control computer 50 sends an instruction to the hammer solenoid 56 to print additional characters in selected data blocks of the receipt form 9. This is shown in FIG. 19 by the step 174.

In a standard receipt form 9, there are a fixed number of character columns in which a character may be printed. Following completion of the step 174, the computer 50 makes inquiry 176 to determine if the total number of columns has passed the character wheels 12. A negative response to the inquiry 176 advances the system operation to step 178 wherein the character selection computer 52 again selects a character for printing on a receipt form 9. The form is advanced in response to the step 180 by energizing the stepper motor 19 connected to the drive wheels 16 and 18. The sequence of operation then returns to the step 164 and is repeated to the inquiry 176.

After printing in the last column on the receipt form 9, a positive response results from the inquiry 176 and the sequence advances to the inquiry 184. Inquiry 184 looks for the index mark 78 on the receipt form 9. This is evidenced by a signal from the sensor 38 as supplied to the print control computer 50 through the AND gate sensing circuit 48. A negative response to the inquiry 184, after the maximum number of columns on a receipt form 9 has passed the character wheels 12, advances the sequence to a fault shutdown 186 and the system shuts down indicating a fault in the character printer operation.

A positive response to the inquiry 184 indicates that the mark 78 has passed the light source 34 and the computer 50 completes the inquiry 188 to determine if the signal wheel 40 is in a position to generate a signal from the light sensor 46.

As explained previously, by positioning the index mark 78 between the end feed holes 28 of the receipt form 9, when this index mark 78 generates a signal from the light sensor 38, the signal wheel 40, in normal operation, should be in a position to interrupt the light beam from the source 44 to the sensor 46. If a light signal is generated by the sensor 46, a malfunction has occurred and the inquiry 188 provides a positive response which advances the sequence to fault shutdown 186.

In normal operation, the sensor 46 does not generate a signal and the response to inquiry 188 will be negative. This advances the sequence to inquiry 190 which looks at the signals from the sensors 132 and 134 to check the operation of the inked ribbon 80. For normal operation, a predetermined number of pulse signals should be generated by the sensors 132 and 134 during the movement of a receipt form 9 from the index mark 36 to the index mark 78. If this fixed number of pulses has not been received by the computer 50 from the sensors 132 and 134, inquiry 190 produces a negative response which advances the sequence to the fault shutdown 186. A positive response to the inquiry 190 advances the sequence to the end step 192 indicating a receipt form 9 has been successfully and completely printed in accordance with instructions from the print control computer 50 and the character selection computer 52. The system now recycles to the step 152 to wait a signal indicating the start of the print sequence for a subsequent form 9.

While only one embodiment of the invention, together with modifications thereof, has been described in detail herein and shown in the accompanying drawings, it will be evident that various further modifications are possible without departing from the scope of the invention.

What is claimed is:

1. In an automatic character printer, comprising in combination:

drive wheels having a plurality of indentations positioned about the circumference thereof, at least one endless flexible belt having positioning pins extending therefrom to engage feed holes in a receipt form and including positioning buttons engaging the indentations of said drive wheels, drive means coupled to said drive wheels for moving the receipt form past a print station, character means located at the print station for printing during a printing sequence a number of characters on the receipt form said character means including a plurality of individual characters each of which are positionable to print on the receipt form in response to a character print signal, a sensor responsive to index marks on the receipt form and generating a leading index signal and a trailing index signal, a movement sensor synchronized with the movement of said drive means and generating a receipt form movement signal, control means responsive to the leading index signal, the trailing index signal and the receipt form movement signal and producing a character print signal when the receipt form has been positioned at the print station, said control means including means responsive to the operation of said character means for generating a signal to shut down the printing sequence when the number of characters printed exceed a given number limit before said index sensor generates the trailing index signal, means for locating the receipt form at a printing position, said means for locating including a pressure plate at the print station for applying pressure to the receipt form, and means for forcing the receipt form against said character means to imprint thereon a selected character in response to the character print signal.

2. In an automatic character printer as set forth in claim 1 wherein said means for forcing the receipt form against the said character means includes a reciprocally operated hammer, and a resilient arm interposed between said hammer and the receipt form.

3. In an automatic character printer as set forth in claim 1 wherein said character means includes at least one character wheel rotatably mounted at the print station, and a drive motor for rotating said character wheel in response to the character print signal.

4. In an automatic character printer as set forth in claim 3 including a code wheel for each character wheel and rotatable therewith, each code wheel having character identifying code segments, and sensing means responsive to the character identifying code segments to generate a signal to said control means as an additional input.

5. In an automatic character printer as set forth in claim 1 wherein said movement sensor includes a slotted code wheel mounted to rotate with one of said drive wheels and sensing means responsive to the movement of the slotted code wheels to generate the receipt form movement signal to said control means.

6. In an automatic character printer as set forth in claim 1 wherein said drive means comprises a stepper motor energized by a signal from said control means.

7. In an automatic character printer, comprising in combination:

drive wheels having a plurality of indentations positioned about the circumference thereof, at least one endless flexible belt having positioning pins extending therefrom to engage feed holes in a receipt form and including positioning buttons engaging the indentations of said drive wheels, drive means coupled to said drive wheels for moving the receipt form past a print station, character means located at the print station for operation during a printing sequence and including characters to be printed on a receipt form, the character means positionable to any of the characters in response to a character print signal, a sensor responsive to index marks on the receipt form and generating a leading index signal and a trailing index signal, a movement sensor synchronized with the movement of said drive means and including means for generating a series of receipt form movement signals when said drive means moves, control means responsive to the leading index signal, the trailing index signal and the receipt form movement signals and producing a character print signal when the receipt form has been positioned at the print station, said control means further including means responsive to the series of receipt form movement signals to shut down the printing sequence when said series exceeds an established limit before said control means receives a trailing index signal, means for locating the receipt form at a printing position, said means for locating including a pressure plate at the print station for applying pressure to the receipt form, and means for forcing the receipt form against said character means to imprint thereon a selected character in response to the character print signal.

8. In an automatic character printer, comprising in combination:

drive wheels having a plurality of indentations positioned about the circumference thereof, at least one endless flexible belt having positioning pins extending therefrom to engage feed holes in a receipt form and including positioning buttons engaging the indentations of said drive wheels, drive means coupled to said drive wheels for moving the receipt form past a print station, a character wheel located at the print station and including characters to be printed on the receipt form and positionable to any of the characters in response to a character signal during a printing sequence, a ribbon feed for a marking ribbon to sequentially move the marking ribbon past the character wheel at the print station, means for maintaining the tension on the marking ribbon and for controlling the movement of a feed reel in said ribbon feed, means for sensing movement of the marking ribbon past the print station and generating a ribbon movement signal including, code discs having two concentric rings of alternate light and dark areas, the coded discs rotating such that each ring is interposed between a separate light source and a separate light sensor for generating the ribbon movement signal, control means for producing a character print signal in response to the generated ribbon movement signal, means for locating the receipt form at a printing position, said means for locating including a pressure plate at the print station for applying pressure to the receipt form, means for forcing the receipt form against the character wheel to imprint a selected character on the receipt form in response to a character print signal, and means responsive to the tension on the marking ribbon in said ribbon feed and generating a ribbon break signal to said control means for shutting down the printing sequence upon a loss of tension in the marking ribbon.

* * * * *